United States Patent [19]

Le

[11] 4,269,182

[45] May 26, 1981

[54] UNDERWATER BREATHING DEVICE FOR A SWIMMER

[76] Inventor: Be V. Le, 912 S. Terrace, Wichita, Kans. 67218

[21] Appl. No.: 97,368

[22] Filed: Nov. 26, 1979

[51] Int. Cl.[3] ..... B63C 11/16

[52] U.S. Cl. ..... 128/201.11; 128/201.19

[58] Field of Search ..... 128/201.11, 201.19, 128/201.27

[56] References Cited

U.S. PATENT DOCUMENTS

| | | | |
|---|---|---|---|
| 329,391 | 10/1885 | Huntley | 128/201.19 |
| 4,022,201 | 5/1977 | Diggs | 128/201.11 |

FOREIGN PATENT DOCUMENTS

| | | | |
|---|---|---|---|
| 1806347 | 5/1970 | Fed. Rep. of Germany | 128/201.11 |
| 1124535 | 7/1956 | France | 128/201.11 |
| 775104 | 5/1957 | United Kingdom | 128/201.11 |

*Primary Examiner*—Henry J. Recla

*Attorney, Agent, or Firm*—Edwin H. Crabtree

[57] ABSTRACT

An underwater breathing device used by a swimmer, fisherman, or the like. The device eliminates the need for an oxygen system and provides a float section which holds a pair of breathing tubes upright in the water. One of the tubes has a double-acting valve system which automatically closes when water pressure is applied to the float to keep water from entering the tubes and then to the swimmer's mouth.

2 Claims, 3 Drawing Figures

UNDERWATER BREATHING DEVICE FOR A SWIMMER

BACKGROUND OF THE INVENTION

This invention relates generally to an underwater breathing device and more particularly but not by way of limitation to a breathing device used by a swimmer or a fisherman which allows the user of the device to swim underwater without an oxygen system and allows the person to breathe underwater without fear of receiving water through the air line during the use of the device.

Heretofore there have been various underwater breathing and diving apparatus disclosed in U.S. Pat. No. 1,423,923 to Eckerd, U.S. Pat. No. 2,362,240 to Bonilla and U.S. Pat. No. 2,814,292 to Girden. Also, more recent underwater breathing devices have been disclosed in U.S. Pat. No. 3,064,646 to Miller, U.S. Pat. No. 3,467,091 to Aragona and U.S. Pat. No. 4,061,140 to Saito. None of the prior art patents specifically disclose the structure and advantages of the subject invention as described herein.

SUMMARY OF THE INVENTION

The underwater breathing device for a swimmer includes a unique float section having both a float and rod valve mounted in a hollow tube which prevents water from entering the tube and then into the airline to the swimmer.

The airline includes flexible elastic sections which allow the float section to automatically follow the swimmer in a trailing relationship with the float section maintained in an upright position so that water will not enter the air tubes when the swimmer is underwater.

The breathing device not only allows the swimmer to breathe underwater, but further provides a sound tube with ear covers so that the swimmer can hear sounds above water or the sound tube can be used by someone above water for talking to the swimmer underwater.

The invention is simple in design, lightweight, easy to use, and allows a swimmer or fisherman to swim underwater for extended periods of time without the use of an outside oxygen system.

The underwater breathing device includes a first vertical tube having an upper end portion and an open lower end portion for receiving air therethrough. The lower end portion of the first tube is flared outwardly forming a float seat. A second vertical tube is communicably connected to the upper end portion of the first tube and forms an upside down "J" with the first tube. A buoy and ballast ring are attached to a lower end portion of the second tube for holding the tubes upright in the water. A flexible airline having elastic connections is connected at one end to the lower end portion of the second tube with the other end attached to a mouthpiece adapted for receipt in the swimmer's mouth. A ball-shaped float having a float rod is disposed in and extends upwardly through the open lower end portion of the first tube. The end of the rod is attached to a float rod valve. The first tube includes a valve seat integrally formed therein. The rod valve and the float are received in the valve seat and the flared float seat when the float is raised upwardly by water pressure applied thereon. A sound tube is communicably connected and extends through the second vertical tube and through the flexible airline. The sound tube is connected to a pair of ear covers adapted for receipt over the swimmer's ears.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
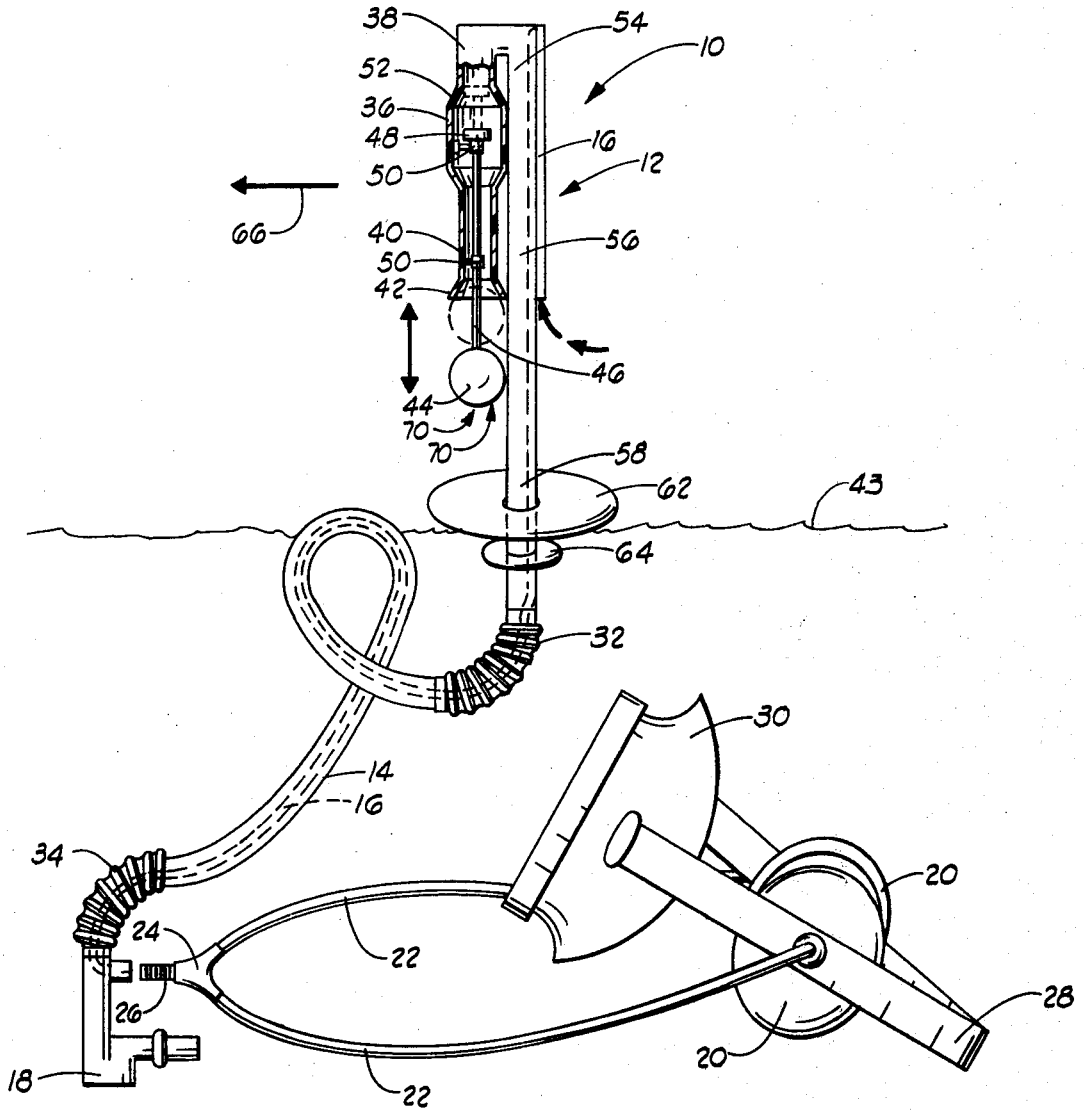
FIG. 1 is a detailed front view of the underwater breathing device.

In FIG. 1 the underwater breathing device is designated by general reference numeral 10. The device 10 includes a float section 12 connected to a flexible underwater airline 14. A sound line 16 is received inside the airline 14 and is shown in dotted lines. A hollow mouthpiece 18 is adapted for receipt in a swimmer's mouth and connected to the lower end of the airline 14. A pair of ear covers 20 are connected to the sound line 16 by a pair of sound tubes 22. The tubes 22 are connected to the top of the mouthpiece 18 by a hollow Y-shaped connector 24. One end of the Y-shaped connector 24 includes a threaded end portion 26 which is threaded into the top of the mouthpiece 18 and is communicably connected to the end of the sound line 16. The ear covers 20 may be connected to a head strap 28 of a diver's mask 30. It can be appreciated that while a diver's mask 30 is shown, the device 10 can be used equally well connected to a diver's helmet or any other type of underwater headgear. The airline 14 further includes an upper elastic section 32 for connecting to the float section 12 and a lower elastic section 34 for connecting to the top of the mouthpiece 18.

The float section 12 includes a first vertical tube 36 which is shown in cross section. The first tube 36 includes an upper end portion 38 and an open lower end portion 40. The end of the open lower end portion 40 is flared outwardly forming a float seat 42. The first tube 36 in a normal upright position is disposed above a water level 43 and further includes a ball-shaped float 44 connected to a vertical float rod 46 which extends upwardly through the open end portion 40 with the upper end of the rod 42 connected to a rod valve 48. The float rod 46 is slidably connected to a pair of rod guides 50 which are attached to the inner circumference of the first tube 36. Integrally formed inside the upper end portion 38 of the tube 36 is a valve seat 52 for receiving the rod valve 48 therein when the float 44 is raised upwardly by water pressure applied thereon.

The first vertical tube 36 is communicably connected to an upper end portion 54 of a second vertical tube 56. A lower end portion 58 of the second tube 56 extends downwardly through the water level 43 and is connected to the upper elastic section 32 of the airline 14.

The first tube 36 and second tube 56 have an upside down "J" appearance and are held upright on top of the water level 43 by a buoy 62 and a ballast ring 64 attached to the lower end portion 58 of the second tube 56. The ballast ring 64 positioned below the buoy 62 on the tube 56 aids the float section 12 in maintaining the air tubes 36 and 56 in a vertical position above the water.

In FIG. 1 the sound tube 16 can be seen extending upwardly through the second tube 56 and out the upper end portion 54. The sound tube 16 can be used by someone talking to the swimmer underwater or may be used merely to hear sounds above the water level 43.

Figure 2:
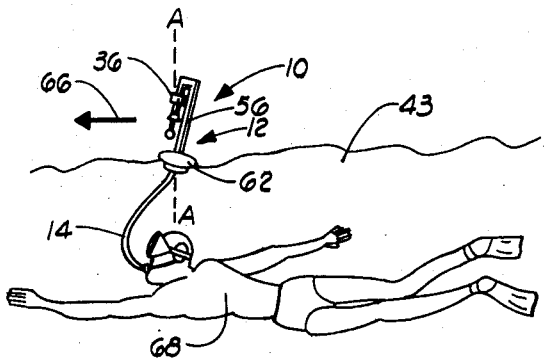
FIG. 2 illustrates a swimmer using the underwater breathing device with the device properly connected for use.

In operation, the device 10 works properly when the float section 12 is connected to the airline 14 with the upper elastic section 32 extending outwardly towards the direction indicated by arrow 66. In FIG. 2 a swimmer 68 heading in the direction of arrow 66 shows the device 10 properly connected to the swimmer 68. In this manner, depending upon the speed of the swimmer 68, the first tube 36 of the float section 12 is tilted away from the surface of the water level 43 to insure the prevention of water entering upwardly into the air tubes 36 and 56 and downwardly through the airline 14 into the swimmer's mouth. In FIG. 2 line A—A indicates a vertical line through the device 10 and shows the second tube 36 tilted to the left and away from the water level 43.

Figure 3:
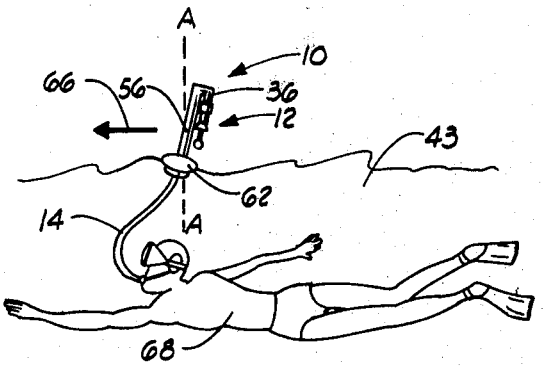
FIG. 3 is similar to FIG. 2 but with the underwater breathing device improperly connected for use.

In FIG. 3 the same swimmer 68 heading in the direction of arrow 66 is shown with the device 10 improperly connected with the first tube 36 to the rear or to the left of the second tube 56 and extending downwardly toward the water level 43. In this manner the device 12 is more likely to take in water since the first tube 36 is leaning toward the water level 43.

Should the water level 43 raise above the buoy 62 and ballast ring 64 by wave action or any other means, the float 44 will have water pressure applied thereto and indicated by arrows 70. The float 44 will automatically rise upwardly into the float seat 42 with the float rod 46 raising upwardly and the valve 48 seating against the valve seat 52. The float 44 and valve 48 act as a double-acting valve arrangement to prevent water from entering upwardly into the first tube 36 and downwardly into the second tube 56. Because of this arrangement should any water be received above the float 44 and into the lower end portion 40 of the first tube 36, the valve 48 will seat itself against the valve seat 52 prior to the water finding its way upwardly and past the valve seat 52. In this way, a fail-safe system is provided to prevent water entering the airline 14 and reaching the swimmer 68 when he is underwater.

Changes may be made in the construction and arrangement of the parts or elements of the embodiments as described herein without departing from the spirit or scope of the invention defined in the following claims.

What is claimed is:

1. An underwater air and sound device for a swimmer, the device comprising:

a first vertical tube having an upper end portion and a opened lower end portion for receiving air therethrough, the lower end portion adapted to be disposed above the water level;

a second vertical tube having an upper end portion and a lower end portion, the upper end portion communicably connected to the upper end portion of the first tube, the tubes having an upside down "J" appearance;

a buoy attached to the lower end portion of the second tube for holding the tubes upright in the water;

a mouth piece adapted for receipt in the swimmer's mouth when the swimmer is under water;

a flexible air line with one end communicably connected to the lower end portion of the second tube, the other end of the air line attached to the mouth piece;

a ball shaped float having a float rod attached thereto, the float rod extending upwardly into the lower end portion of the first tube, the end of the rod attached to a float rod valve, the first tube having a valve seat integrally formed therein, the rod valve received in the valve seat when the float is raised upwardly by water pressure applied thereon;

ear covers adapted for receipt over the swimmers ears; and a sound tube connected to the upper end portion of the second tube and extending downwardly therethrough and through the flexible airline, the lower end of the sound tube connected to the ear covers.

2. An underwater air and sound device for a swimmer, the device comprising:

a first vertical tube having an upper end portion and an opened lower end portion for receiving air therethrough, the lower end portion adapted to be disposed above the water level, the open end of the lower end portion flared outwardly forming a float seat;

a second vertical tube having an upper end portion communicably connected to the upper end portion of the first tube and a lower end portion, the tubes having an upside down "J" appearance;

a buoy attached to the lower end portion of the second tube for holding the tubes upright in the water;

a ballast ring attached to the lower end portion of the second tube and disposed below the buoy for assisting the buoy in holding the tubes upright in the water;

a mouth piece adapted for receipt in the swimmer's mouth;

a flexible air line having one end communicably connected to the lower end portion of the second tube, the other end of the air line attached to the mouth piece;

a ball shaped float having a float rod attached thereto, the float rod extending upwardly through the opened lower end portion of the first tube, the end of the rod attached to a float rod valve, the first tube having a valve seat integrally formed therein, the rod valve received in the valve seat and the float received in the flared float seat when the float is raised upwardly by water pressure applied thereon;

ear covers adapted for receipt over the swimmers ears; and a sound tube communicably connected and extending through the second vertical tube and through the flexible air line, the end of the second tube connected to the ear covers.

* * * * *